US006460454B1

(12) United States Patent
Oike et al.

(10) Patent No.: US 6,460,454 B1
(45) Date of Patent: Oct. 8, 2002

(54) SYSTEM FOR MAKING HEAT-SENSITIVE STENCIL MASTER

(75) Inventors: Hikaru Oike; Yukio Irie, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/413,587

(22) Filed: Oct. 6, 1999

(30) Foreign Application Priority Data

Oct. 6, 1998 (JP) ..... 10-283855

(51) Int. Cl.[7] ..... B41C 1/14

(52) U.S. Cl. ..... 101/128.4; 101/128.21; 400/120.01; 347/206

(58) Field of Search ..... 101/128.4, 128.21, 101/129, 127, 114; 400/120.01, 120.05, 120.06, 120.07, 120.08, 120.09, 120.1, 120.12, 120.13, 120.14; 347/206, 211, 218, 200

(56) References Cited

U.S. PATENT DOCUMENTS

| | | | | |
|---|---|---|---|---|
| 4,980,698 A | * | 12/1990 | Inoue | 347/200 |
| 5,216,951 A | * | 6/1993 | Yokoyama et al. | 101/128.4 |
| 5,297,878 A | * | 3/1994 | Saito et al. | 400/120.02 |
| 5,355,793 A | * | 10/1994 | Sato et al. | 101/128.24 |
| 5,384,585 A | | 1/1995 | Okumura | 347/206 |
| 5,415,090 A | * | 5/1995 | Natori et al. | 101/128.21 |
| 5,537,140 A | | 7/1996 | Hayashi et al. | 400/120.02 |
| 5,592,209 A | * | 1/1997 | Hasegawa et al. | 347/206 |
| 5,729,274 A | | 3/1998 | Sato | 400/120.02 |
| 5,809,879 A | | 9/1998 | Yokoyama et al. | 101/128.4 |

FOREIGN PATENT DOCUMENTS

| | | |
|---|---|---|
| JP | 01238956 | 9/1989 |
| JP | 94030891 | 4/1994 |
| JP | 6191003 | 7/1994 |
| JP | 7241974 | 9/1995 |
| JP | 8067061 | 3/1996 |
| JP | 8-309954 | 11/1996 |
| JP | 2638390 | 4/1997 |
| JP | 2732532 | 12/1997 |

* cited by examiner

*Primary Examiner*—Andrew H. Hirshfeld
*Assistant Examiner*—Minh Chau
(74) *Attorney, Agent, or Firm*—Nixon Peabody LLP; Donald R. Studebaker

(57) ABSTRACT

A heat-sensitive stencil master making system includes a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master material. Each of the heater elements is longer in the main scanning direction than in the sub-scanning direction.

5 Claims, 7 Drawing Sheets

SYSTEM FOR MAKING HEAT-SENSITIVE STENCIL MASTER

BACKGROUND OF THE INVENTION

1. Field of the Invention

This invention relates to a system for making a heat-sensitive stencil master, and more particularly to a system for making a heat-sensitive stencil master in which the heat-sensitive stencil master is made by use of a thermal head comprising a number of heater elements.

2. Description of the Related Art

As a system for making a heat-sensitive stencil master, there has been known a system in which a thermal head having a number of heater elements is brought into contact with the thermoplastic film side of heat-sensitive stencil master material, thereby imagewise perforating the stencil master material.

FIG. 7 shows an example of such a conventional stencil master making system. In FIG. 7, a heat-sensitive stencil master material 1 is conveyed between a platen roller 3 and a thermal head 4 in the direction of arrow A by the platen roller 3 which is driven by an electric motor (not shown) while being pinched between a pair of driven rollers (conveyor rollers) 2. In this way, the thermoplastic film side 12 of the heat-sensitive stencil master material 1 is brought into contact with rectangular heater elements 40 of the thermal head 4, and by selectively energizing the heater elements 40 by a drive means (not shown), the thermoplastic film side 12 of the stencil master material 1 is perforated in an imagewise pattern.

FIG. 8 is an enlarged schematic plan view of the thermal head 4. In the thermal head 4, the heater elements 40 are arranged in a row in a main scanning direction, that is, a direction perpendicular to the direction of conveyance of the stencil master material 1 (sub-scanning direction). A pattern layer (electrode) 42 is connected to each side (in the sub-scanning direction) of each heater element 42 so that the heater elements 42 can be energized independently of each other.

When each of the heater elements 40 is energized and the temperature of the part of the thermoplastic film 12 in contact with the heater element 40 exceeds a shrinkage initiation temperature at which the thermoplastic film 12 begins to shrink, a fine perforation is first formed at a portion opposed to the center of the heater element 40 and is gradually enlarged outward, and when the heater element 40 is de-energized and the temperature of the part of the thermoplastic film 12 in contact with the heater element 40 lowers a shrinkage stop temperature at which the thermoplastic film 12 stops shrinking, the perforation is fixed.

In such a stencil master making system, the size of each heater elements 40 of the thermal head 4 is determined depending on the rate of feed of the stencil master material 1 in the sub-scanning direction and the resolution. In the conventional heat-sensitive stencil master making system, the size of each heater element 40 of the thermal head 4 is determined, for instance, to satisfy the following formula in order to make adequate the shape of the perforation and to prevent offset and/or run of ink due to excessive perforation.

$B/Pb=\alpha\times A/Pa$ wherein A represents the length of the heater element in the main scanning direction, B represents the length of the heater element in the sub-scanning direction, Pa represents the dot pitches in the main scanning direction, Pb represents the dot pitches in the sub-scanning direction and $\alpha\geqq 1.0$. Accordingly when the dot pitches in the main scanning direction and the dot pitches in the sub-scanning direction are equal to each other, the heater element 40 becomes longer in the sub-scanning direction than in the main scanning direction. See, for instance, Japanese Patent Publication Nos. 26838390 and 2732532.

Further it has been known that the size of the perforation is increased as the power supplied to the thermal head 4 is increased, is reduced as the heating time Tp of the thermal head 4 is shortened, and is increased in the sub-scanning direction as the heating time ratio β is increased, wherein the heating time ratio β is the ratio of the heating time Tp of the thermal head 4 to the speed of movement of the thermal head 4 T1 (line cycle) relatively to the stencil master material 1 ($\beta=Tp/T1$).

Further it has been known that, in the case of the thermal head of the conventional heater element size, load on the thermal head is lightened and the durability of the thermal head is extended as the power supply is reduced and the heating time ratio β is increased. However, when the power supply is reduced and the heating time ratio β is increased, the perforations are enlarged in the sub-scanning direction and it becomes difficult to render the perforations discrete in the sub-scanning direction, which means that perforations are elongated in the sub-scanning direction and a proper stencil master cannot be obtained if the sub-scanning speed is increased.

Nowadays it is important to shorten the time required for printing. For this purpose, it is important to increase the perforating speed of the thermal head and make a stencil master at a higher speed. Specifically it is necessary to shorten the line cycle to not longer than 2.0 msec, e.g., 1.5 msec though it has been generally 2.5 msec.

However attempts to shorten the line cycle to 1.5 msec will encounter the following difficulties. That is, since the time for which power is supplied to the thermal head is shortened, the thermal head is not sufficiently heated and sufficiently large perforations cannot be obtained. This problem may be overcome by ensuring sufficient energy (power supply×time) by increasing power supply to the thermal head. However this approach is disadvantageous in that the service life of the heater elements is shortened when the power supply to the thermal head is increased.

When the number by which the heater elements in the thermal head is divided in time division drive of the thermal head is reduced (e.g., when stencil master making is to be effected at a high speed, the number of division is reduced to 2 whereas the number of division is normally 4) so that power supply to each heater element is reduced and the heating time ratio β can be increased, load on the thermal head is lightened and durability of the thermal head is extended. However, such two-shift drive of the thermal head results in elongation of the heating time relatively to the dot pitches in the sub-scanning direction and the perforations arranged in the sub-scanning direction can be merged. When the perforations are merged, an excessive amount of ink can be transferred to the printing paper and problems such as offset, deterioration of image quality and the like can be caused.

Thus so long as the conventional thermal head in which each heater element is longer in the sub-scanning direction than in the main scanning direction is used, the heating time within which discrete perforations can be obtained is limited by the line cycle and it is difficult to form discrete perforations while driving the heater elements by reduced power supply so that durability of the thermal head is not shortened.

SUMMARY OF THE INVENTION

In view of the foregoing observations and description, the primary object of the present invention is to provide a stencil master making system in which a thermal head which can form discrete perforations even if the head heating time is increased.

Another object of the present invention is to provide stencil master making system which can form discrete perforations without shortening the service life of the thermal head even when the stencil master is to be made at a high speed.

In accordance with a first aspect of the present invention, there is provided a heat-sensitive stencil master making system comprising a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master material, wherein the improvement comprises that each of the heater elements is longer in the main scanning direction than in the sub-scanning direction.

In accordance with a second aspect of the present invention, there is provided a heat-sensitive stencil master making system comprising a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master material, wherein the improvement comprises that each of the heater elements satisfies the following formula (1), $$B/Pb=\alpha\times A/Pa \quad (1>\alpha\geqq 0.3) \tag{1}$$

wherein A represents the length of the heater element in the main scanning direction, B represents the length of the heater element in the sub-scanning direction, Pa represents the dot pitches in the main scanning direction, and Pb represents the dot pitches in the sub-scanning direction.

It is preferred that the stencil master making system of the present invention be provided with a thermal head drive means which drives the thermal head so that the following formula (2) is satisfied, $$0.25<\beta<1.0 \tag{2}$$

wherein β represents the heating time ratio Tp/T1 which is the ratio of the heating time Tp of the heater elements to the line cycle T1.

Further it is preferred that the stencil master making system of the present invention be provided with a sub-scanning means which conveys the stencil master material in the sub-scanning direction relatively to the thermal head at a speed v which satisfies the following formula (3)

$$V=Pb/T1 \tag{3}$$

Wherein Pb represents the dot pitches in the sub-scanning direction and T1 represents the line cycle which is not longer than 2.0 msec.

In the stencil master making system of the present invention, perforations which are discrete in the sub-scanning direction can be obtained even if the sub-scanning speed is increased so that resolution in the main scanning direction becomes equal to that in the sub-scanning direction since the heater elements in the thermal head is longer in the main scanning direction than in the sub-scanning direction.

Further even in the case where the resolution in the main scanning direction differs from that in the sub-scanning direction, the perforations can be discrete in the sub-scanning direction so long as formula (1) is satisfied.

Further when formula (2) and/or formula (3) is satisfied, a stencil master in which the perforations are of a proper size and discrete can be obtained even by high-speed stencil master making operation where the line cycle is short and it is difficult to elongate the heating time, and at the same time, since the heating time ratio β can be increased and power supply to the heater elements can be reduced, durability of the thermal head can be ensured.

DESCRIPTION OF THE PREFERRED EMBODIMENT

Figure 1:
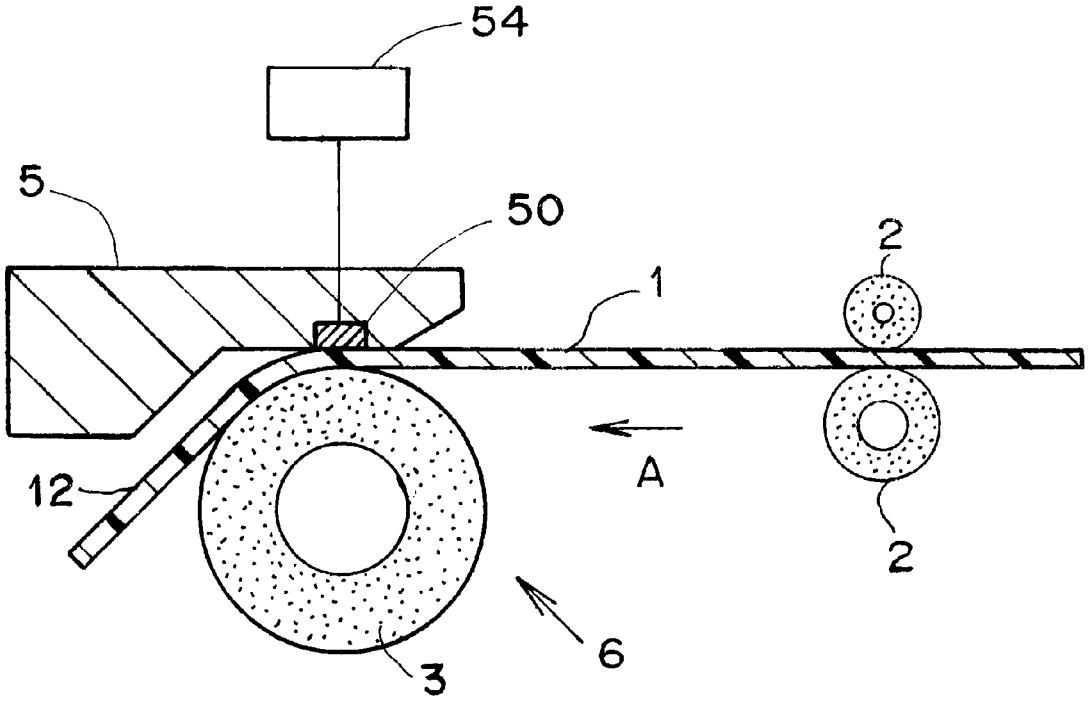
FIG. 1 is a schematic side view showing a stencil master making system in accordance with an embodiment of the present invention.
Figure 5:
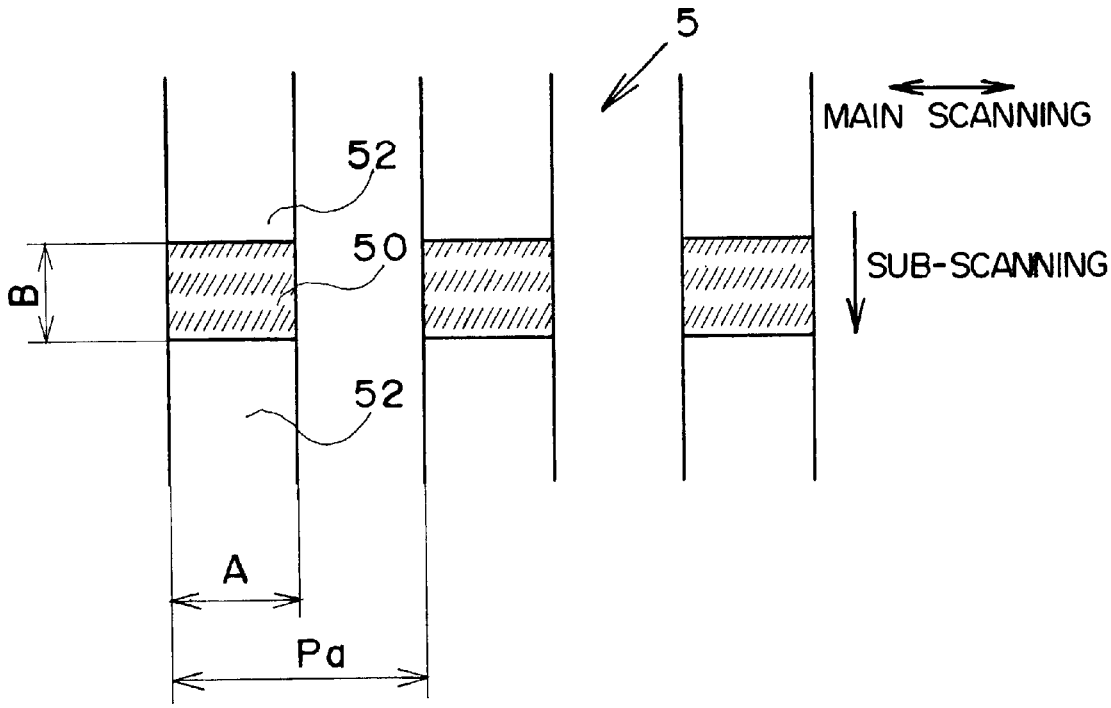
FIG. 5 is a schematic plan view of the thermal head employed in the stencil master making system of this embodiment.

In FIG. 1, a stencil master making system in accordance with an embodiment of the present invention comprises a thermal head 5 formed a number of heater elements 50 arranged in a row in a main scanning direction (FIG. 5). Each heater element 50 is supplied with power from a drive means 54 through a pair of electrodes on opposite sides thereof (as seen in a sub-scanning direction in FIG. 5) and is heated.

A stencil master material 1 is conveyed in the sub-scanning direction by a conveyor means 6 comprising a pair of driven rollers 2 and a platen roller 3 which is driven by an electric motor not shown. The conveyor means 6 conveys the stencil master material 1 in the direction of arrow A between the platen roller 3 and the thermal head 5 so that the speed v at which the material 1 is conveyed (sub-scanning speed). becomes equal to the ratio of the dot pitches Pb in the sub-scanning direction to the line cycle T1 (v=Pb/T1) and so that the dot pitches Pb in the sub-scanning direction become equal to the dot pitches Pa in the main scanning direction.

Figure 2:
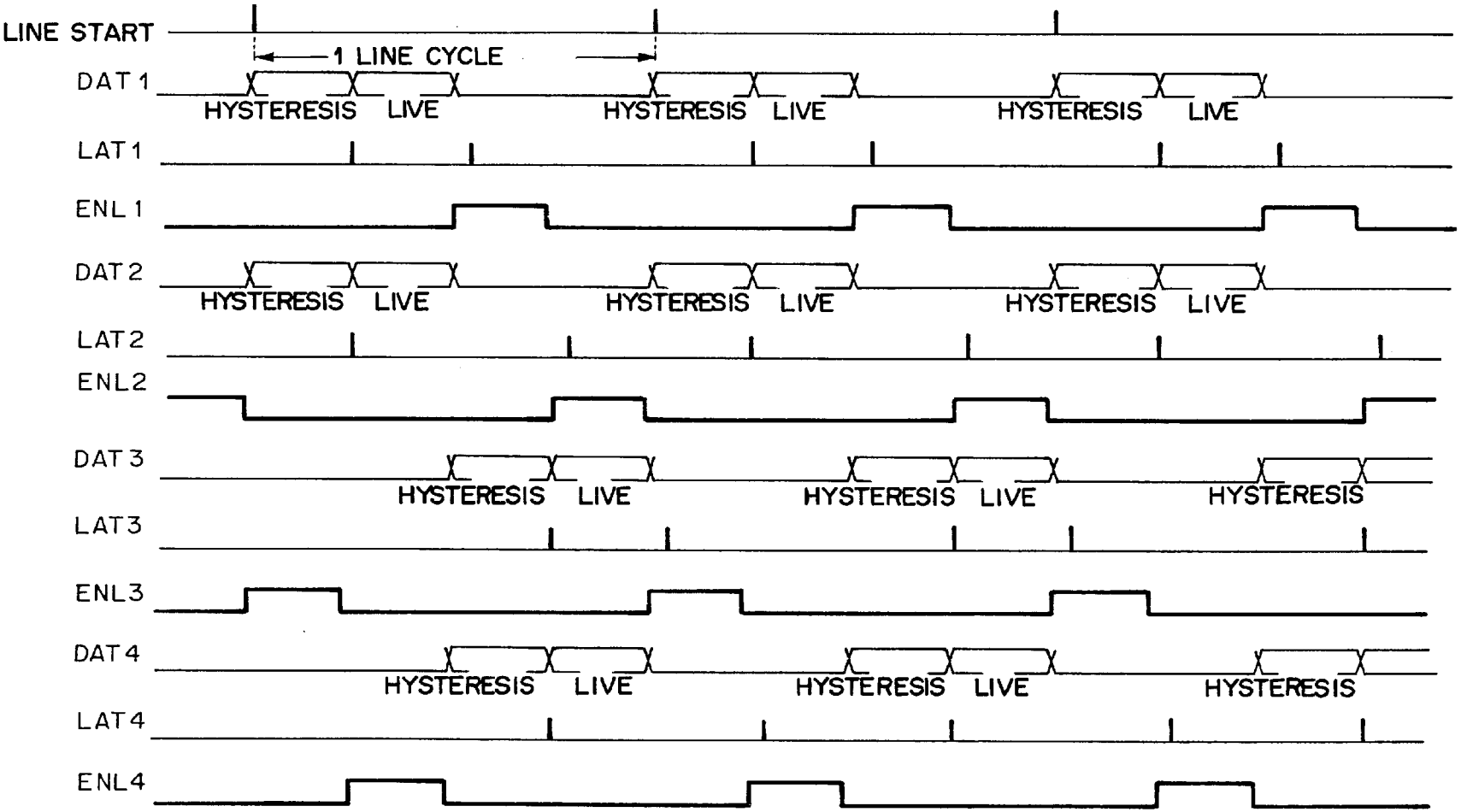
FIG. 2 is a timing chart showing head drive timing when the thermal head is driven by four-shift drive.
Figure 3:
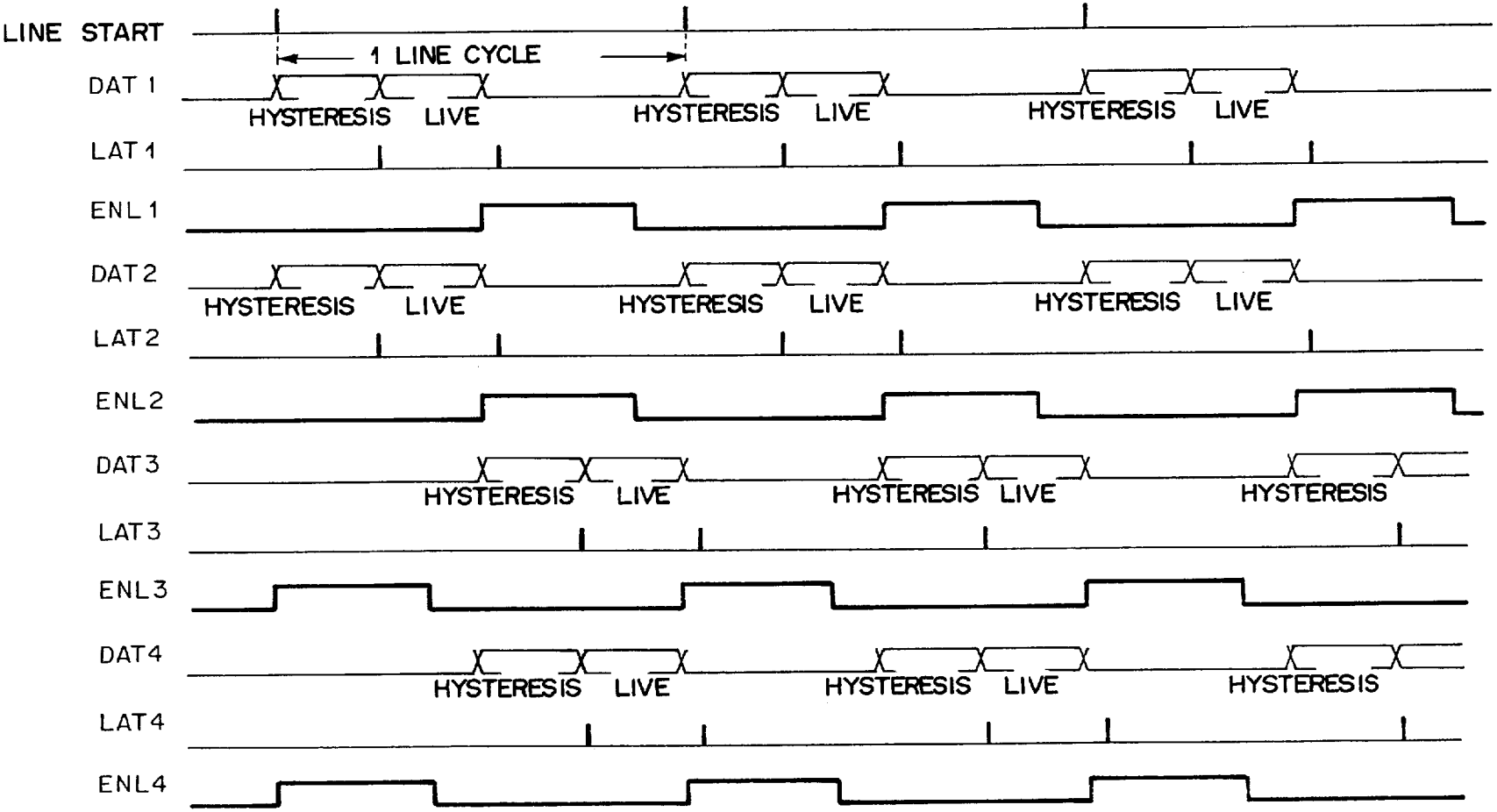
FIG. 3 is a timing chart showing head drive timing when the thermal head is driven by two-shift drive.

FIGS. 2 and 3 show the timing at which the drive means 54 energizes the heater elements 50.

The thermal head 5 is for B4 size, 400 dpi and has 4096 heater elements (picture elements) 50 in total. In order to increase the perforating speed, the heater elements 50 are divided into four blocks each comprising 1024 heater elements 50 and the four blocks are driven by four-shift drive. The drive means 54 controls each block by means of a perforation data signal DAT, a latch signal LAT, an energizing signal ENL and a shift clock signal CLK, though the shift clock signal CLK is not shown in FIGS. 2 and 3. Thus the drive means 54 drives the thermal head 5 through 16 signals (DAT1 to DAT4, LAT1 to LAT4, ENL1 to ENL4, CLK1 to CLK4) in total.

The perforation data signal DAT is input into the thermal head 5 as serial data through a serial input shift register (not shown), is converted into parallel data, and is held in a latch portion (not shown) provided in the thermal head 5 by the latch signal LAT at a predetermined timing. Each heater element 50 is energized at a predetermined timing on the basis of the logical product of the input energizing signal ENL and the data held in the latch portion.

The drive means 54 drives the four blocks of the thermal head 5 by time division drive in the following manner. That is, as shown in FIG. 2, in the case of four-shift drive, the energizing signals ENL1 to ENL4 for any two of the blocks are not turned on simultaneously for the reason of limitation of capacity of the power source. Accordingly, the width of each of the energizing signals ENL1 to ENL4 is ¼ of the line cycle at most.

To the contrast, in the case of two-shift drive, a pair of blocks, e.g., first and second blocks, and third and fourth blocks, are simultaneously driven as shown in FIG. 3. In this case, the width of each of the energizing signals ENL1 to ENL4 can be ½ of the line cycle at most though capacity of the power source is enlarged. In FIGS. 2 and 3, "hysteresis" means first transfer data and "live" means second transfer data.

Figure 4:
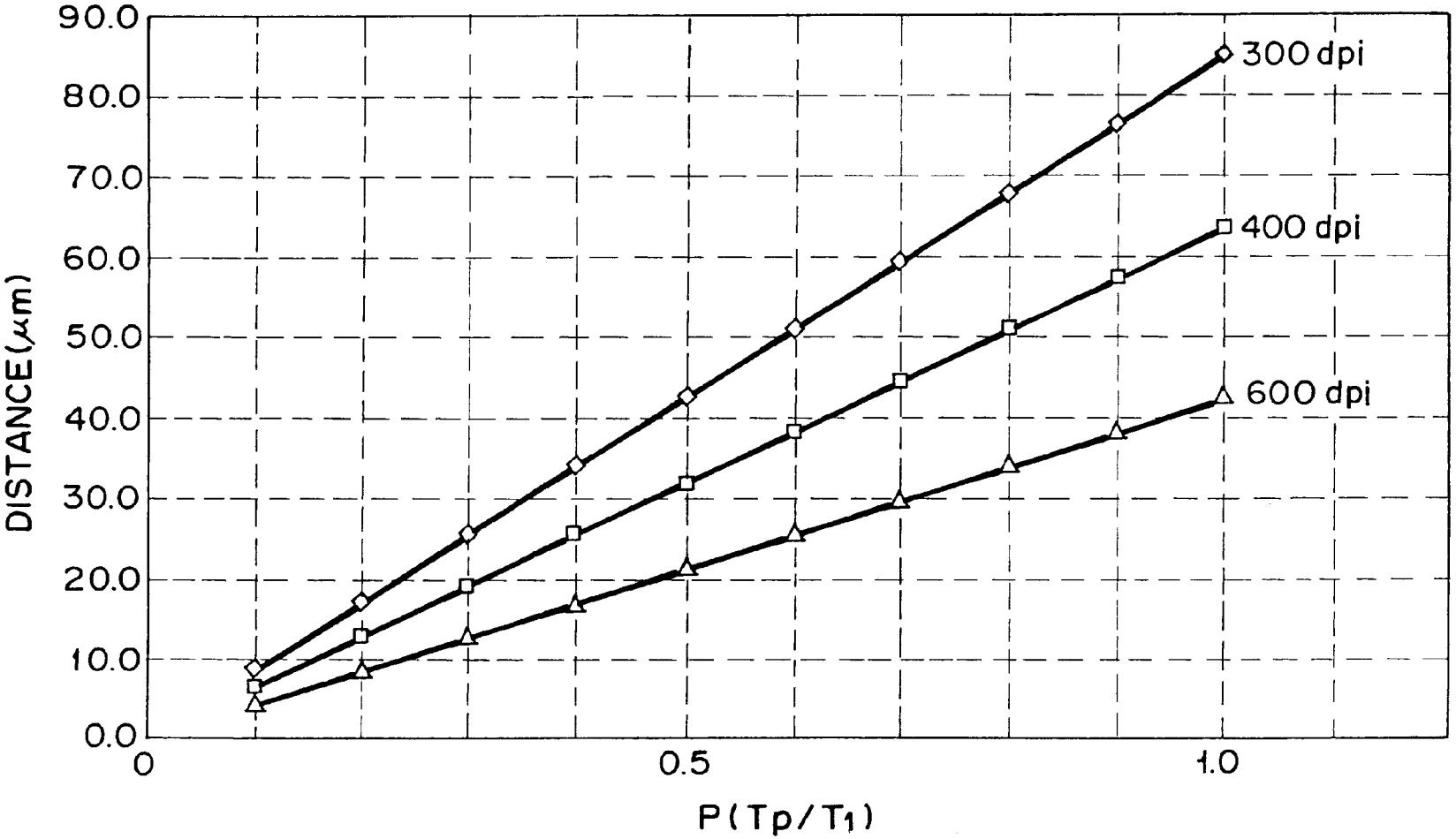
FIG. 4 is a graph showing the relation between the heating time ratio and the distance by which the thermal head is moved.

FIG. 4 is a graph showing the relation between the heating time ratio β (=Tp/T1) and the distance by which the thermal head 5 is moved in the sub-scanning direction relatively to the stencil master material 1. Since sub-scanning is effected by moving the stencil master material 1 relatively to the thermal head 5, perforations become longer in the sub-scanning direction as the distance by which the thermal head 5 is moved in the sub-scanning direction relatively to the stencil master material 1 becomes larger. For the reason of temperature correction, heating hysteresis control and the like, drive means 54 controls the thermal head 5 so that the heating time ratio β becomes about 0.16 in the case of four-shift drive and about 0.26 in the case of two-shift drive.

When the drive means 54 controls the thermal head 5 so that the heating time ratio β is in the range of $0.25<\beta<1.0$, power supply to the heater elements 50 can be reduced and durability of thermal head 5 can be improved.

FIG. 5 schematically shows in plan the thermal head 5. Each heater element 50 is A in length in the main scanning direction and B in length in the sub-scanning direction. A and B satisfy the following formula (1)

$$B/Pb=\alpha\times A/Pa \quad (1>\alpha\geqq 0.3) \tag{1}$$

wherein Pa represents the dot pitches in the main scanning direction, and Pb represents the dot pitches in the sub-scanning direction. Accordingly when the dot pitches Pa in the main scanning direction is equal to the dot pitches Pb in the sub-scanning direction, the length A in the main scanning direction becomes longer than the length B in the sub-scanning direction.

When the length A in the main scanning direction is longer than the length B in the sub-scanning direction, the electric resistance between the electrodes 52, and accordingly, it is necessary that a should be not smaller than 0.3 in order to sufficiently heat the heater element 50.

When the thermal head 5 which satisfies the above formula (1) is used and the stencil master material 1 is moved in the sub-scanning direction at predetermined pitches Pb relatively to the thermal head 5, the perforations thermally formed in the thermoplastic film 12 of the material 1 by the thermal head 5 are not continuous in the sub-scanning direction but are discrete in the sub-scanning direction.

Since the length B in the sub-scanning direction of the heater element 50 is smaller than the heater element employed in the conventional system, heat energy applied to the thermoplastic film 12 per unit area is reduced as compared with in the conventional system, the perforations which are formed in the thermoplastic film 12 by heater elements 50 adjacent to each other in the main scanning direction can be discrete provided that the dot pitches Pa in the main scanning direction and the length A of the heater elements 50 in the main scanning direction are kept equal to those in the conventional system.

Thus, the perforations formed in the thermoplastic film 12 by the heater elements 50 can be discrete both in the main scanning direction and the sub-scanning direction, whereby unnecessary transfer of ink is suppresses during printing and the phenomenon of offset can be prevented. Further, the parts between the perforations on the stencil master are filled by run of ink and sharp printed images can be obtained.

Further since the conveyor means 6 conveys the stencil master material 1 so that v=Pb/T1 is satisfied, the conveyor means 6 must convey the stencil master material 1 in the sub-scanning direction at a higher speed v in order to make the dot pitches Pb in the main scanning direction equal to the conventional dot pitches Pb when the line cycle T1 is changed from 2.5 msec to 1.5 msec.

Accordingly, in the stencil master making system of this embodiment, the perforations formed in the thermoplastic film 12 of the stencil master material 1 by the heater elements 50 can be discrete in both the main scanning direction and the sub-scanning direction even if the line cycle is shortened and the stencil master is made at a higher speed.

In the stencil master making system of the present invention, the dot pitches Pa in the main scanning direction need not be equal to that Pb in the sub-scanning direction so long as the size of the heater elements of the thermal head 5 satisfies the above formula (1). When the dot pitches Pb in the sub-scanning direction are larger than the dot pitches Pa in the main scanning direction, that is, when the resolution in the sub-scanning direction is lower than that in the main scanning direction, the perforations can be discrete in the sub-scanning direction even if the perforations are elongated in the sub-scanning direction by the amount by which the resolution in the sub-scanning direction is lower than that in the main scanning direction.

EXAMPLE

Stencil masters were made by use of the following thermal heads and perforations obtained were investigated. The result was as shown in FIGS. 6A to 6E.

Embodiment

A 400 dpi thermal head having the following heater element array was mounted on a heat-sensitive stencil master making system and a stencil master was made on the basis of an original having a solid image and an image of characters by two-shift drive of the thermal head with the heating time Tp and the line cycle T1 set as follows. As a heat-sensitive stencil master material, 007 D master, P-type (trade name) available from RISO KAGAKU CORPORATION, which was laminated film comprising 2 μm thick polyester film and porous base film (Manila hemp tissue paper, 8.5 g/m$^2$) bonded together by adhesive, was employed.

| | |
|---|---|
| Length in main scanning direction of heater element (A) | 30 μm |
| Length in sub-scanning direction of heater element (B) | 20 μm |
| Dot pitches in main scanning direction (Pa) | 62.5 μm |
| Dot pitches in sub-scanning direction (Pb) | 62.5 μm |
| Heating time (Tp) | 400 μsec |
| Line cycle (Tl) | 1.5 msec |
| Tp/Tl (β) | 0.266 |

Figure 6A:
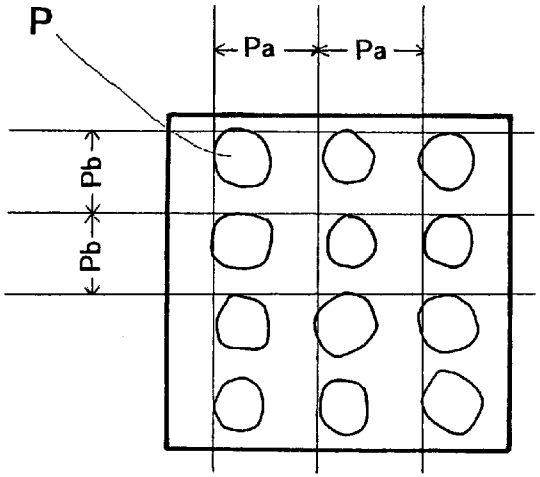
FIGS. 6A to 6E are views showing perforations formed by a stencil master making system in accordance with the present invention, and those in accordance with a prior art and comparative examples.

A part of the stencil master thus obtained was observed through an optical microscope. In this case, the perforations corresponding to both the solid image and the image of the characters on the original were discrete in both the main scanning direction and the sub-scanning direction with unperforated portion running between the perforations in a grid pattern as shown in FIG. 6A. In FIG. 6A and FIGS. 6B to 6E, P denotes a perforation.

Printing was carried out using the stencil master. The printed matter was sharp and faithful to the original with the unperforated portions between the perforations, where ink is not directly transferred, filled with run of ink to connect the perforations. Further, when, after printing a predetermined number of copies, the back side of a copy at the middle of the stack of the copies was observed. There was observed little offset on the back side of the copy.

Prior Art: Normal Speed Stencil Master Making

A 400 dpi thermal head having the following heater element array (each heater element being of the conventional size) was mounted on the same heat-sensitive stencil master making system as used in the embodiment above and a stencil master was made on the basis of the same original as used in the embodiment above by four-shift drive of the thermal head with the heating time Tp and the line cycle T1 set as follows. The same heat-sensitive stencil master material as used in the embodiment above was employed.

| | |
|---|---|
| Length in main scanning direction of heater element (A) | 30 μm |
| Length in sub-scanning direction of heater element (B) | 40 μm |
| Dot pitches in main scanning direction (Pa) | 62.5 μm |
| Dot pitches in sub-scanning direction (Pb) | 62.5 μm |
| Heating time (Tp) | 400 μsec |
| Line cycle (Tl) | 2.44 msec |
| Tp/Tl (β) | 0.164 |

Figure 6B:
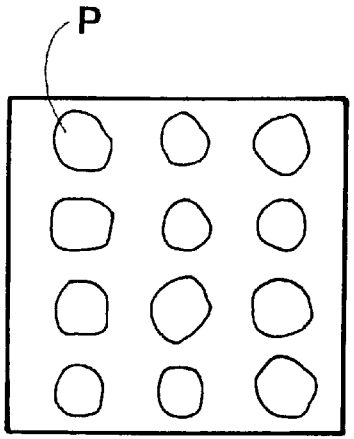

A part of the stencil master thus obtained was observed through an optical microscope. In this case, the perforations corresponding to both the solid image and the image of the characters on the original were discrete in both the main scanning direction and the sub-scanning direction as shown in FIG. 6B. Further, there was observed little offset on the back side of the copies.

Comparative Example 1

Conventional Heater Element Size and High-speed Stencil Master Making

A 400 dpi thermal head having the following heater element array (each heater element being of the conventional size) was mounted on the same heat-sensitive stencil master making system as used in the embodiment above and a stencil master was made on the basis of the same original as used in the embodiment above by two-shift drive of the thermal head (as in the embodiment above) with the heating time Tp and the line cycle T1 set as follows. The same heat-sensitive stencil master material as used in the embodiment above was employed.

| | |
|---|---|
| Length in main scanning direction of heater element (A) | 30 μm |
| Length in sub-scanning direction of heater element (B) | 40 μm |
| Dot pitches in main scanning direction (Pa) | 62.5 μm |
| Dot pitches in sub-scanning direction (Pb) | 62.5 μm |
| Heating time (Tp) | 400 μsec |
| Line cycle (Tl) | 1.5 msec |
| Tp/Tl (β) | 0.266 |

Figure 6C:
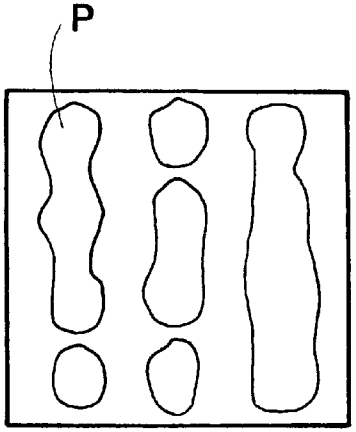

A part of the stencil master thus obtained was observed through an optical microscope. In this case, the perforations were not discrete in the sub-scanning direction as shown in FIG. 6C.

Comparative Example 2

Square Heater Element and High-speed Stencil Master Making

A 400 dpi thermal head having the following heater element array (each heater element being square in shape) was mounted on the same heat-sensitive stencil master making system as used in the embodiment above and a stencil master was made on the basis of the same original as used in the embodiment above by two-shift drive of the thermal head with the heating time Tp and the line cycle T1 set as follows. The same heat-sensitive stencil master material as used in the embodiment above was employed.

| | |
|---|---|
| Length in main scanning direction of heater element (A) | 30 μm |
| Length in sub-scanning direction of heater element (B) | 30 μm |
| Dot pitches in main scanning direction (Pa) | 62.5 μm |
| Dot pitches in sub-scanning direction (Pb) | 62.5 μm |
| Heating time (Tp) | 400 μsec |
| Line cycle (Tl) | 1.5 msec |
| Tp/Tl (β) | 0.266 |

Figure 6D:
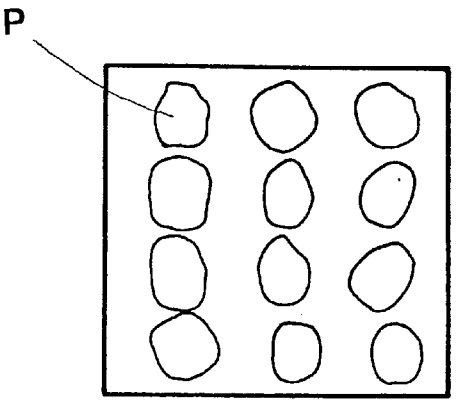

A part of the stencil master thus obtained was observed through an optical microscope. In this case, the perforations were discrete but excessively elongated in the sub-scanning direction as shown in FIG. 6D.

Comparative Example 3

Square Heater Element and Normal-speed Stencil Master Making

A 400 dpi thermal head having the following heater element array (each heater element being square in shape) was mounted on the same heat-sensitive stencil master making system as used in the embodiment above and a stencil master was made on the basis of the same original as used in the embodiment above by four-shift drive of the thermal head with the heating time Tp and the line cycle T1 set as follows. The same heat-sensitive stencil master material as used in the embodiment above was employed.

| | |
|---|---|
| Length in main scanning direction of heater element (A) | 30 μm |
| Length in sub-scanning direction of heater element (B) | 30 μm |
| Dot pitches in main scanning direction (Pa) | 62.5 μm |
| Dot pitches in sub-scanninq direction (Pb) | 62.5 μm |
| Heating time (Tp) | 400 μsec |
| Line cycle (Tl) | 2.44 msec |
| Tp/Tl (β) | 0.164 |

Figure 6E:
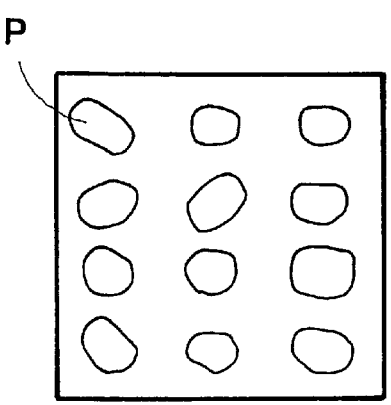
Figure 7:
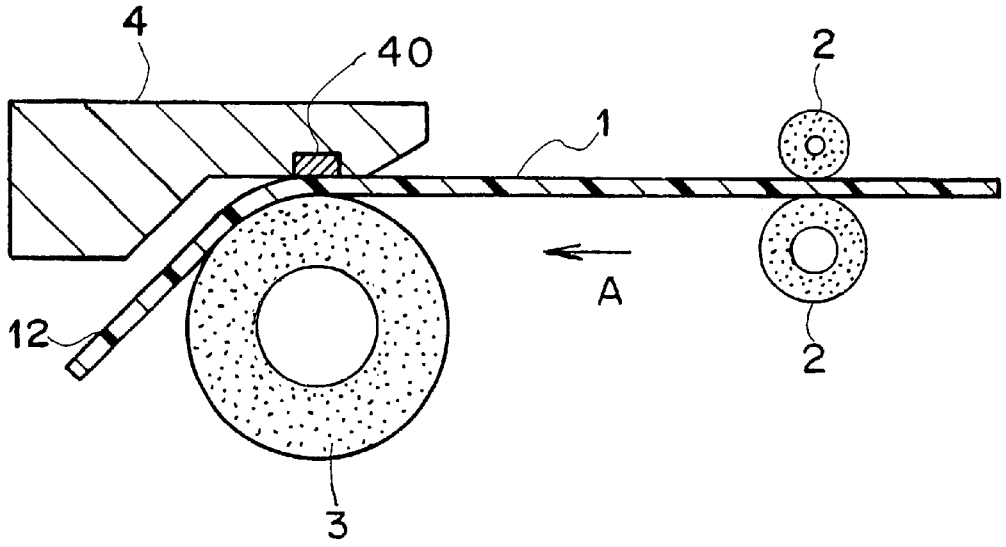
FIG. 7 is a schematic side view showing a conventional stencil master making system.
Figure 8:
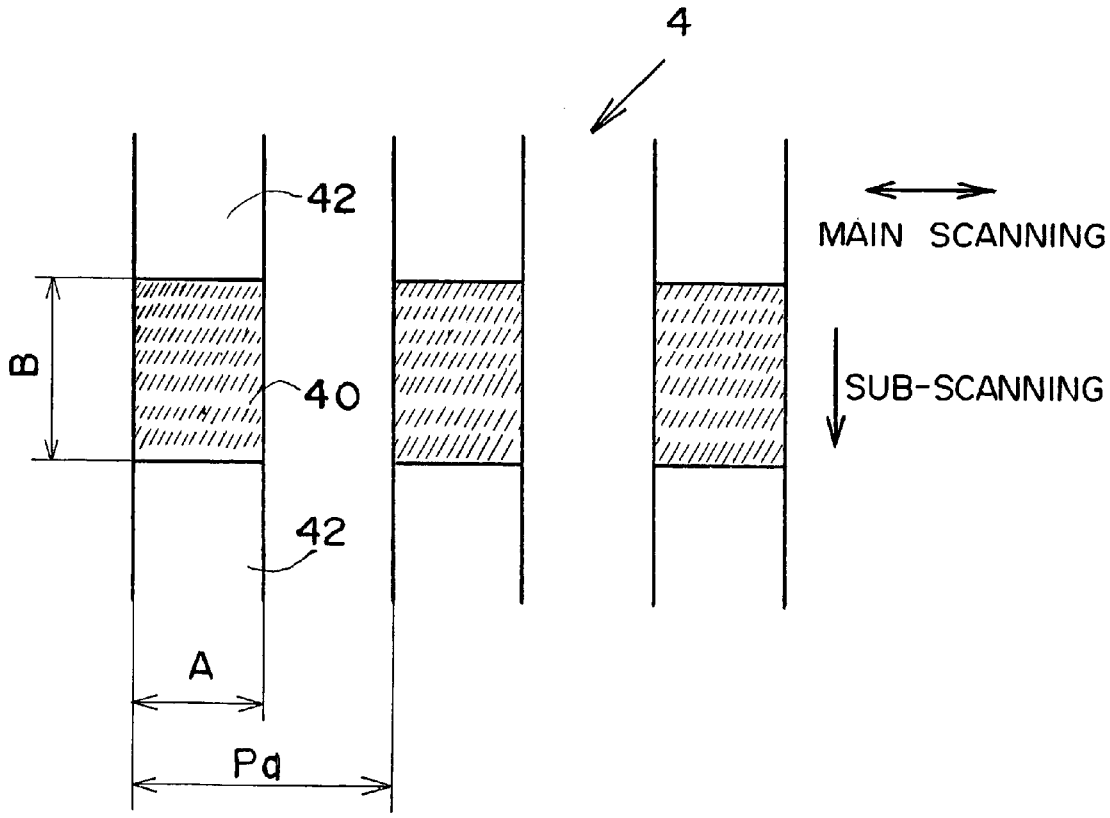
FIG. 8 is a schematic plan view of the thermal head employed in the conventional stencil master making system.

A part of the stencil master thus obtained was observed through an optical microscope. In this case, the perforations were too short in the sub-scanning direction as shown in FIG. 6E.

As can be understood from description above, perforations which are discrete in the sub-scanning direction can be surely obtained even if the sub-scanning speed is increased, whereby perforations which are discrete in both the main scanning direction and the sub-scanning direction can be obtained at a high speed, since the heater elements in the thermal head is longer in the main scanning direction than in the sub-scanning direction.

What is claimed is:

1. A heat-sensitive stencil master making system comprising;

a thermal head having an array of a number of heater elements which extend in a main scanning direction substantially perpendicular to a sub-scanning direction with the thermal head being moved relative to a heat-sensitive stencil master material for imagewise perforating the heat-sensitive stencil master material and each of the heater elements is longer in the main scanning direction than in the sub-scanning direction for maintaining discrete perforations;

a thermal head drive means which drives the thermal head so that a formula $0.25<\beta<1.0$ is satisfied, wherein β represents the heating time ratio Tp/T1 which is the ratio of the heating time Tp of the heater elements to the line cycle T1.

2. A heat-sensitive stencil master making system comprising a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master material, and each of the heater elements satisfying the following formula $$B/Pb=\alpha\times A/Pa(1>\alpha\geqq 0.3),$$

wherein A represents the length of the heater element in the main scanning direction, B represents the length of the heater element in the sub-scanning direction, Pa represents the dot pitches in the main scanning direction, and Pb represents the dot pitches in the sub-scanning direction.

3. A heat-sensitive stencil master making system as defined in claim 2 further comprising a thermal head drive means which drives the thermal head so that formula $0.25<\beta<1.0$ is satisfied, wherein β represents the heating time ratio Tp/T1 which is the ratio of the heating time Tp of the heater elements to the line cycle T1.

4. A heat-sensitive stencil master making system comprising a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master making, each of the heater elements being longer in the main scanning direction than in the sub-scanning direction; and a thermal head drive means which conveys the stencil master material in the sub-scanning direction relatively to the thermal head at a speed v which satisfies formula v=Pb/T1 wherein Pb represents the dot pitches in the sub-scanning direction and T1 represents the line cycle which is not longer than 2.0 msec.

5. A heat-sensitive stencil master making system comprising a thermal head having an array of a number of heater elements which extends in a main scanning direction substantially perpendicular to a sub-scanning direction in which the thermal head is moved relatively to heat-sensitive stencil master material when imagewise perforating the heat-sensitive stencil master material, each of the heater elements satisfies the following formula $$B/Pb=\alpha\times A/Pa(1>\alpha\geqq 0.3),$$

wherein A represents the length of the heater element in the main scanning direction, B represents the length of the heater element in the sub-scanning direction, Pa represents the dot pitches in the main scanning direction, and Pb represents the dot pitches in the sub-scanning direction; and a thermal head drive means which conveys the stencil master material in the sub-scanning direction relatively to the thermal head at a speed v which satisfies formula v=Pb/T1 wherein Pb represents the dot pitches in the sub-scanning direction and T1 represents the line cycle which is not longer than 2.0msec.

* * * * *